United States Patent [19]

Jones

[11] 4,017,254

[45] Apr. 12, 1977

[54] RECIRCULATING FURNACE-DRYER COMBINATION

[75] Inventor: Allen Jacob Jones, Grants Pass, Oreg.

[73] Assignee: S. J. Agnew, Tenino, Wash.

[22] Filed: Dec. 15, 1975

[21] Appl. No.: 640,963

[52] U.S. Cl. ..... 432/72; 34/212; 110/8 R

[51] Int. Cl.[2] ..... F23J 15/00

[58] Field of Search ..... 110/8; 432/72; 34/212, 34/216, 217, 224

[56] References Cited

UNITED STATES PATENTS

| | | | |
|---|---|---|---|
| 2,490,855 | 12/1949 | Burns | 236/15 C |
| 2,725,224 | 11/1955 | Pierce | 34/224 |
| 3,319,587 | 5/1967 | Albertson et al. | 110/8 R |
| 3,456,604 | 7/1969 | Ehrenzeller et al. | 110/8 R |
| 3,620,177 | 11/1971 | Bøving | 110/8 R |
| 3,627,290 | 12/1971 | Grieve | 432/72 |
| 3,675,600 | 7/1972 | Jones | 110/8 R |

*Primary Examiner*—John J. Camby
*Attorney, Agent, or Firm*—Kolisch, Hartwell, Dickinson & Stuart

[57] ABSTRACT

A recirculating furnace-dryer combination including a combustion chamber, a housing surrounding the combustion chamber for maintaining a greater than atmospheric pressure within the combustion chamber, a dryer in which a greater than atmospheric pressure may be maintained, and a feed conduit through which heated gases may be supplied from the combustion chamber to the dryer. Return conduits receive exhaust gases from the veneer dryer and recirculate them through a fan for repressurization into the housing, from which they are recirculated into the combustion chamber. A fuel feed, including an air lock, is operable to feed fuel into the combustion chamber, with an air lock maintaining a pressurized condition in the combustion chamber. Temperature sensing devices in the dryer are connected to controls to operate dampers in the feed conduits to maintain a preselected temperature range within the veneer dryer. A pressure sensing device in the combustion chamber senses changes in pressure in the combustion chamber to actuate automatic controls for controlling the rate of feed of fuel to the combustion chamber and the rate of entry of recirculated dryer gases and atmospheric air into the combustion chamber as necessary to maintain a balanced pressurized operating condition.

16 Claims, 4 Drawing Figures

RECIRCULATING FURNACE-DRYER COMBINATION

BACKGROUND AND SUMMARY OF THE INVENTION

This invention relates to a recirculating furnace-dryer combination, and more particularly to such a combination in which a greater than atmospheric pressure is maintained throughout the system during operation with dryer gases being recirculated into the combustion chamber of the furnace for incineration to reduce pollution and to produce more efficient operation of the system.

The discharge of air pollutants from furnaces, dryers, etc. is coming under ever increasing control as to the quantities of pollutants which may be allowed to escape into the atmosphere. For this reason, many have attempted to reduce the amounts of pollutants which are allowed to escape into the atmosphere from such operations.

Most furnaces, dryers, etc. now in use have been criticized as failing to provide the complete and efficient combustion necessary to meet air pollution requirements, while others, although possibly meeting the performance requirements are prohibitively expensive. A primary example of the need for increased efficiency and control of air pollution and greater efficiency in combustion is found in veneer, or lumber, dryers. In such dryers, as the veneer, or lumber, is dried, moisture is given off and in this moisture are found hydrocarbons and wood fiber particles.

In the past, it has been a general policy to allow the material released from the wood in the dryer and the exhaust from the furnace merely to escape into the atmosphere producing a highly visible form of pollution. Further, by allowing such materials to merely exhaust to the atmosphere, not only have pollutants been allowed to escape, but considerable quantities of heat energy are lost which is a considerable loss of resources in this period of needed energy conservation.

To further alleviate the energy problem with which we are faced, several have attempted to provide furnaces which are capable of burning waste wood products which are produced in the manufacture of the veneer, or lumber, which is to be dried in the dryer. Although such material may burn, it generally has a high moisture content and thus it has been difficult to burn efficiently and with minimal pollution.

A general object of the present invention, therefore, is to provide a novel furnace-dryer combination including a combustion chamber which produces heated gases which may be routed to dryer, with the gases including pollutants produced in the dryer being recirculated through a substantially closed loop system back into the combustion chamber for reincineration of pollutants and production of relatively clean exhaust from the system.

More specifically, an object of the invention is to provide such a novel combination in which a housing encloses the combustion chamber to maintain an above atmospheric pressure in the combustion chamber, the dryer is constructed to be capable of maintaining a greater than atmospheric pressure therein, and means is provided for returning gases from the dryer under pressure to the housing and thereafter admitting such gases and included pollutant materials from the housing into the combustion chamber at various zones in the combustion chamber to produce efficient and complete combustion of materials within the return gases.

A further object of the invention is to provide such novel combination wherein not only are the return gases with their pollutants reincinerated by introduction into the combustion chamber, but they also are capable of contributing to the heat value of the gases produced in the combustion chamber.

Yet another object is to provide such novel apparatus in which automatic controls are provided for introducing heated gases as required into the dryer to maintain temperatures in the dryer in a preselected range, and means for sensing operational characteristics in the combustion chamberr for feeding fuel and return gases to the combustion chamber as required to maintain a balanced flow of gases through the system to maintain desired temperatures in the dryer.

A still further object is to provide novel a furnace-dryer combination in which solid fuel is fed to the combustion chamber, and an air lock is provided in the fuel feed apparatus to aid in maintaining a pressurized condition within the combustion chamber.

Yet another object of the invention is to provide a novel furnace-dryer combination in which moisture from the solid fuel itself and moisture contained in the return gases from the dryer combine in the combustion chamber to produce moist heated gases for introduction into the dryer to produce faster and more efficient drying of the materials within the dryer.

Another object of the invention is to provide a novel recirculating furnace-dryer combination in which a fan for producing greater than atmospheric pressure within the combustion chamber and dryer is connected in the return conduit through which return gases are recirculated from the dryer to a housing enclosing the combustion chamber, whereby the fan is in a position to pump gases which are coolest in the system, as opposed to being placed in the conduit feeding gases at maximum temperature from the combustion chamber to the dryer. By placing the fan at a position in which the gases supplied thereto are at a minimum temperature there is less injurious effect to the mechanical workings of the fan.

Yet another object of the present invention is to provide a novel recirculating furnace-dryer combination in which selected pressure and temperatures may be maintained throughout the system by a series of automatic control devices without the need for previously used refractory dampers mounted for controlled shifting within the stream of combustion gases in the combustion chamber.

Yet another object of the invention is to provide a novel recirculating furnace-dryer combination which is substantially fully pressurized throughout at a pressure greater than atmospheric pressure, which permits the system to operate at higher enthalpy levels, and produce greater operating efficiencies throughout.

A still further object of the invention is to provide a novel furnace-dryer combination in which the combustion chamber includes a cylindrical vessel into which fuel is placed for burning and the sides of the vessel having openings extending therethrough at angles to lines extending radially from the center of the vessel, whereby gases may be injected through the openings, or nozzles, to produce a swirling, or vortex, movement of materials and gases within the vessel for more complete and efficient combustion.

A still further object is the provision of means for holding a portion of moist fuel in a region adjacent the combustion vessel for drying prior to injecting the materials into the combustion vessel.

These and other objects and advantages will become more fully apparent as the following description is read in conjunction with the drawings.

DRAWINGS

DETAILED DESCRIPTION OF AN EMBODIMENT OF THE INVENTION

Figure 1:
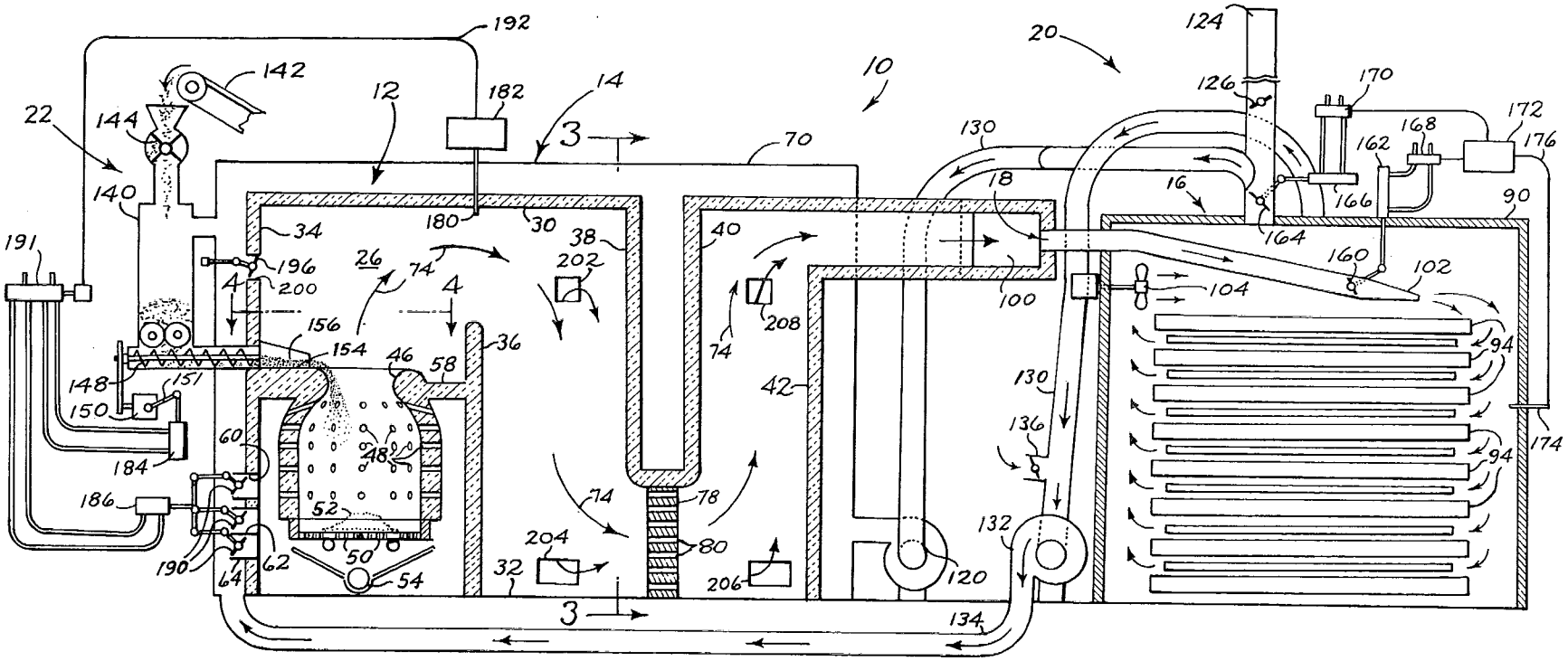
FIG. 1 is a schematic side elevation view of a recirculating furnace-dryer combination constructed according to an embodiment of the invention.
Figure 2:
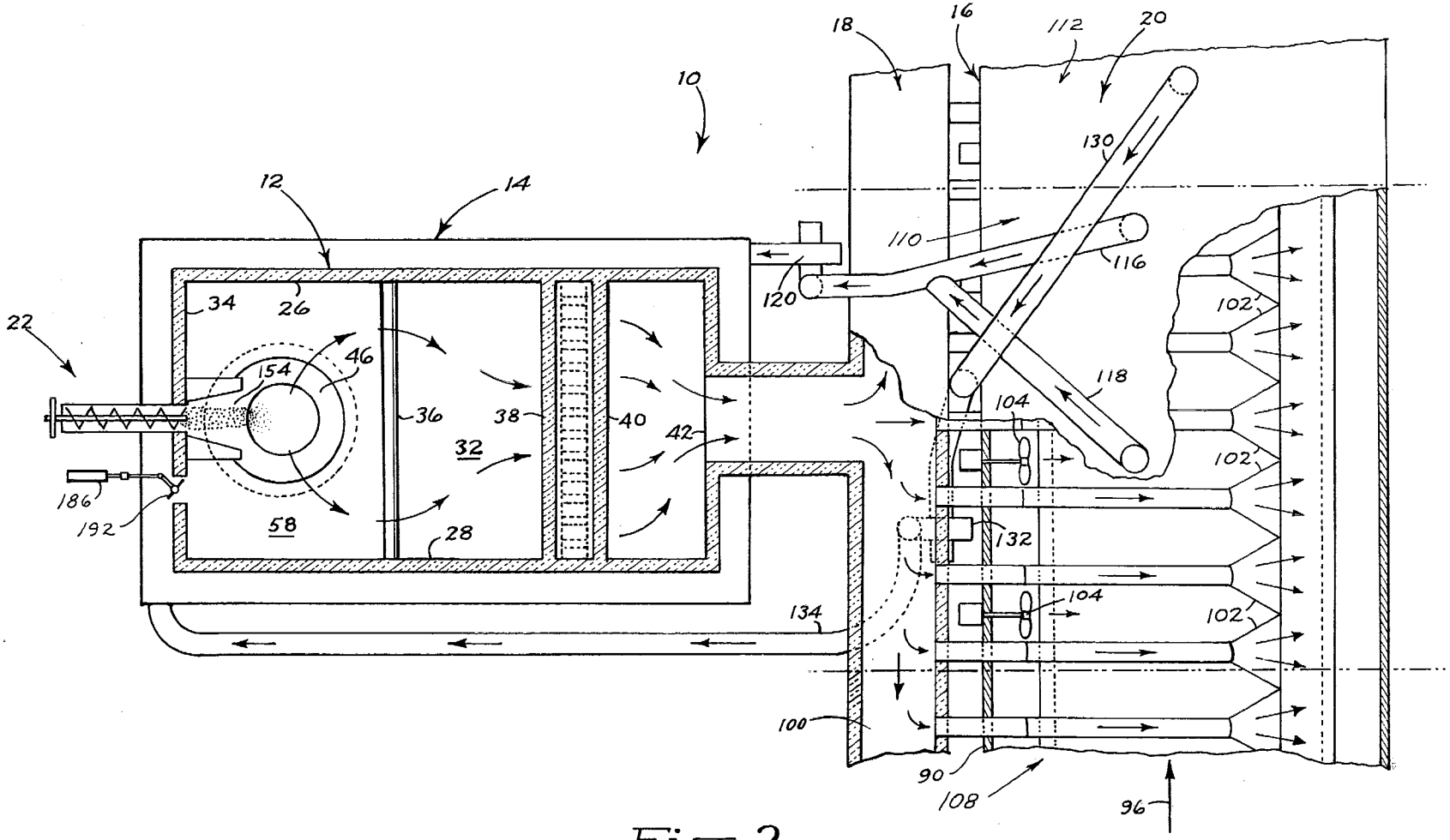
FIG. 2 is a schematic plan view of the furnace-dryer combination illustrated in FIG. 1.

Referring to the drawings, and first more specifically to FIGS. 1 and 2, at 10 is indicated generally a recirculating furnace-dryer combination according to the invention. The combination includes generally a combustion chamber 12, a pressure housing 14 surrounding the chamber, a veneer dryer 16, feed conduit means 18 for carrying heated gases from the combustion chamber to the dryer, return conduit means 20 for returning dryer gases to housing 14 for recirculating into the combustion chamber, and fuel feed means 22.

Describing combustion chamber 12 in greater detail, it includes opposed, laterally spaced, upright refractory side walls 26, 28, refractory ceiling and floor 30, 32, respectively, and a plurality of upright refractory walls spaced apart longitudinally of the side walls and extending therebetween, indicated generally at 34, 36, 38, 40, 42, respectively. The spaces between various pairs of walls in the structure define combustion zones within the furnace, with the space between walls 34, 36 being referred to as a primary combustion zone, the space between walls 36, 38 being referred to as a secondary combustion zone, and the space between walls 40, 42 referred to as a tertiary combustion zone. As is seen in FIG. 1, wall 34 extends from floor to ceiling in the furnace to provide an end wall for the combustion chamber, whereas walls 36, 42 join with floor 32 but stop short of ceiling 30, and walls 38, 40 join with ceiling 30 but stop short of floor 32.

Figure 4:
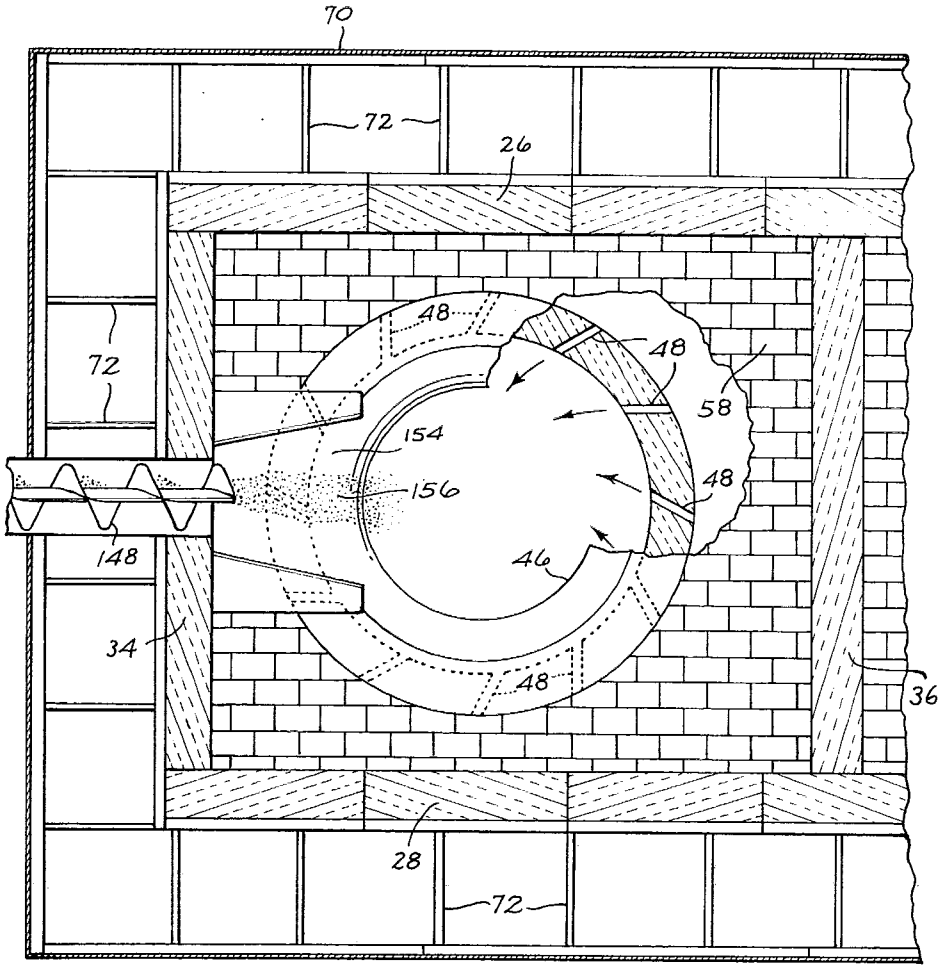
FIG. 4 is an enlarged top plan view taken generally along the line 4—4 in FIG. 1 of a combustion vessel in the combustion chamber of the furnace.

A substantially cylindrical combustion vessel 46 is illustrated in side elevation cross section in FIG. 1 and in a more detailed plan view in FIG. 4 with portions broken away. The side walls of vessel 46 are substantially cylindrical throughout a major portion of their height, but curve inwardly adjacent their upper ends to give the vessel a somewhat bottle shaped configuration. As is best seen in FIG. 4, a plurality of openings, or nozzles, 48 extend through the side walls of vessel 46 and are disposed at substantially equal angles relative to radial lines extending outwardly from the center of the vessel. These angularly disposed openings are operable to produce a whirling motion to gases within the vessel to produce a vortex during operation, as will be described in greater detail below.

Referring again to FIG. 1, a pair of dump grates 50 are positioned adjacent the lower end of vessel 46 and are rotatable about substantially horizontal axes. When positioned horizontally as illustrated in FIG. 1, they form a substantially continuous base for the combustion vessel on which a pile of solid fuel, such as that indicated at 52, may rest for burning. Grates 50 have bores extending vertically therethrough, through which air and return gases from the dryer may be fed upwardly through the pile of burning material, as will be described below.

The grates are rotatable to vertical dumping positions, whereby residue or waste material therefrom may be dumped onto a waste removal conveyor indicated generally at 54 for removal from the furnace.

Figure 3:
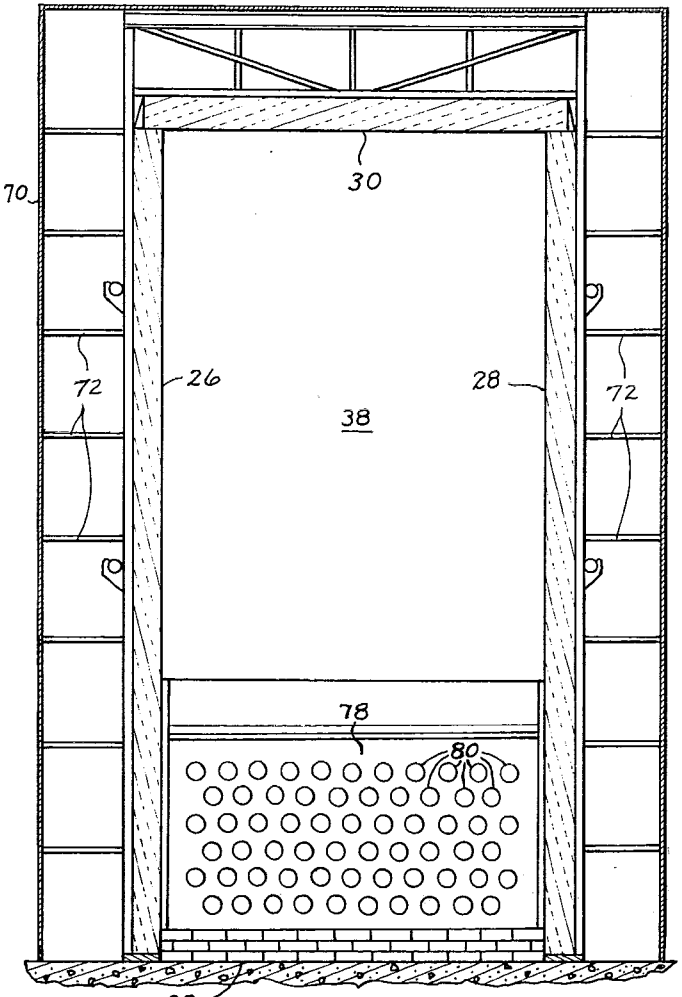
FIG. 3 is an enlarged cross-sectional view of a portion of the combination taken generally along the line 3—3 in FIG. 1.

A refractory block covering, indicated generally at 58 in FIGS. 1, 2 and 3, surrounds the upper end of vessel 46 and extends between side walls 26, 28 and walls 34, 36. Covering 58 and the lower portions of the side walls and walls 34, 36 provide a presssure chamber which surrounds vessel 46. A plurality of openings 60, 62, 64 are defined in wall 34 extending between housing 14 and the pressure chamber surrounding vessel 46.

Describing housing 14, it is primarily a rectangular sheet metal shroud, or cover, 70 having side walls and a top which are spaced outwardly from the side walls and top of furnace 12. As is seen in FIGS. 3 and 4, the sheet metal covering 70 is supported outwardly from the refractory walls of the furnace by support bars 72 extending outwardly from support framework for the refractory walls. Housing 14 is substantially airtight, whereby a greater than atmospheric pressure may be maintained therein.

Referring again to FIG. 1, heated gases produced by incineration, or burning, of material within vessel 46 follow a circuitous path through the furnace as indicated by arrows 74. These arrows indicate that the combustion gases travel upwardly from vessel 46 into the primary, or first, combustion zone, pass over wall 36 and then progress downwardly in the secondary, or second, combustion zone to a region beneath walls 38, 40. A refractory block 78 having a plurality of openings 80 extending horizontally therethrough serves to control the flow of such gases as they pass under walls 38, 40. The combustion gases then pass upwardly through the tertiary, or third, combustion zone and then over the top of wall 42 to continue on toward dryer 16.

Veneer dryer 16 includes a dryer housing 90 which is constructed to be able to maintain a greater than atmospheric pressure therein while veneer is conveyed therethrough for drying. Within the dryer housing are a plurality of vertically spaced, substantially horizontal dryer decks which are operable to support and carry veneer sheets horizontally through the dryer in a direction extending away from the viewer in FIG. 1 and in the direction of arrow 96 in FIG. 2.

Feed conduit means 18 for feeding heated combustion gases from the furnace to the dryer includes a plenum chamber 100 connected to the outfeed end of furnace 12 and having a plurality of exhaust nozzles 102 connected thereto for exhausting heated combustion gases into the dryer housing. A plurality of fans 104 are operable to produce circulation of heated gases within the dryer housing so that the heated gases circulate over and around the veneer carried on the dryer decks through the dryer housing.

The dryer includes at least three zones. The first, or primary heating zone, 108 is nearest the infeed end of the dryer housing and is the region in which heated gases from the furnace initially contact the veneer. In an intermediate zone 110 the veneer is subjected to additional heat, and at this point moisture is released from the veneer along with hydrocarbons, wood fiber particles, and possibly other pollutants. The third, or cooling, zone is indicated 112 adjacent the downstream end of the dryer and at this point a degree of cooling occurs and additional moisture and pollutants are released. It should be realized that the construction of the dryer housing is such that all three of these zones may be maintained at a greater than atmospheric pressure.

Return conduit means 20 includes a plurality of gas return ducts. Referring to FIGS. 1 and 2, a pair of ducts 116, 118 connect to the top of dryer housing 90 over zone 110 and connect to the infeed side of a motor driven fan 120. The outfeed side of fan 120 connects directly with the interior of housing 14 to return gases from the dryer to the interior of the housing surrounding furnace 12. As is seen in FIG. 1, an exhaust stack 124 having an adjustable damper 126 therin permits a minor portion of the gases exiting from the dryer to escape into the atmosphere.

Another duct 130 connects at one of its ends to the third, or cooling zone, 112 of the dryer and at its other end is connected to the infeed side of a motor driven fan 132. The outfeed side of fan 132 is connected through a duct 134 to the interior of housing 14 adjacent the infeed end of the furnace. As is best seen in FIG. 1, a damper controlled opening 136 in the side of duct 130 permits the admission of some atmospheric air into fan 132 and thus into the housing surrounding the furnace. The recirculation of the gases from the cooling zone prevents the release of what are referred to as fugitive gases which in the past generally have been allowed to escape into the working area of the plant.

Fuel feed 22 includes a hopper 140 which is fed by an overlying conveyor 142. An air lock 144 adjacent the top of the hopper is operable to maintain a pressurized condition within the hopper and fuel feed system. The air lock includes a rotatable vane device which receives solid fuel from conveyor 142 and upon rotating about a horizontal axis drops the fuel into hopper 140, all the while maintaining at least two opposed vanes in contact with surrounding housing structure to maintain a pressure-tight seal within. A motor driven screw conveyor 148 is operable to carry fuel from the base of hopper 140 to the combustion chamber. A variable speed motor 150 is operable to drive screw conveyor 148 at selectively controlled speeds as will be described below.

An apron 154 formed at the outfeed end of conveyor 148 and adjacent the upper end of combustion vessel 46 provides a holding region for fuel prior to its being forced into the combustion vessel. A pile of such material is indicated generally at 156. While the fuel is held on apron 154 the heat in the combustion chamber is operable to produce a drying effect to predry the material prior to its being forced into the combustion vessel.

Describing the controls for the flow of gases throughout the system, and referring still to FIG. 1, each of exhaust nozzles 102 has a variable damper 160 mounted therein. All of dampers 160 are operatively connected to controllers, such as the rod of a double-acting ram 162. Extension and retraction of ram 162 serves to open or close dampers 160 in the nozzles to control the flow of heated gases from the furnace into the dryer. The flow of return, or dryer, gases from the dryer through ducts 116, 118, 130 is controlled by variable dampers such as that indicated at 164 in FIG. 1 which is controlled by extension and retraction of a double-acting ram 166. Rams 162, 166 are operatively connected to sources of fluid pressure through solenoid actuated valves 168, 170, respectively. Valves 168, 170 are operatively connected to a control cicruit 172 which is operable to automatically control their function. A temperature sensing device, which may be a thermocouple, 174 is positioned in the dryer to sense the temperature of gases therein. This temperature sensing device is operatively connected to control circuit 172 through a conductor 176.

Explaining briefly the control function of the devices just described, if thermocouple 174 senses that the temperature within the dryer has fallen below a preselected level, control circuit 172 operates valve 168 to produce actuation of ram 162 to open dampers 160 to permit additional quantities of heated gases to flow through nozzles 102 to raise the temperature in the dryer. Simultaneously, dampers 164 in the return conduits may be closed by actuation of ram 166 to maintain such heat within the dryer. Should a greater than desired temperature be sensed within the dryer dampers 160 are closed and dampers 164 opened to allow the dryer to cool.

Referring to FIG. 1, a pressure sensing probe 180 extends into the combustion chamber between the primary and secondary conbustion zones to sense the pressure within the combustion chamber. The probe is connected to a control circuit 182 which includes a pressure sensing switch.

A double-acting ram 184 is operatively connected to a speed control arm 151 of motor 150 to vary the speed of the screw conveyor upon extension or retraction of the ram. Another ram 186 is operatively connected to a plurality of dampers 190 in openings 60, 62, 64, for controlling the positions of the dampers within these openings upon extension and retraction of ram 186. Rams 184, 186 are connected through a solenoid operated valve 191 to a source of fluid under pressure. Control circuit 182 is connected through a conductor 192 to valve 191 for controlling the operation of the valve to govern operation of rams 184, 186.

Explaining the operation of the control devices just described, should probe 180 sense a pressure lower than a preselected pressure within the combustion chamber, control circuit 182 is operable to actuate valve 191 to cause rams 184 to actuate screw conveyor 148 to feed additional fuel to the combustion vessel and to actuate ram 186 to open dampers 190 to admit greater quantities of return gases and ambient air from the housing to the combustion chamber to produce more heat in the combustion chamber. Should a pressure of a greater than desired level be sensed by the probe 180, screw conveyor 148 would be slowed or stopped, and dampers 190 would be shifted toward closed positions.

Additional control of the operation of the furnace is provided by dampers such as that indicated at 196 for controlling the passage of gases from housing 14 into the combustion chambers through openings such as those indicated at 200, 202, 204, 206 and 208 opening into the various combustion zones in the furnace.

Describing the operation of the furnace and dryer combination, operation of fans 120, 132 is operable to produce a greater than atmospheric pressure within housing 14 and thus a greater than atmospheric pressure within the furnace. A greater than atmospheric pressure also is produced within dryer 16. Solid fuel fed to hopper 140 is carried by screw conveyor 148 onto apron 154, from which it falls into vessel 46 onto dump grates 50. The accumulated pile of fuel on the grates is ignited and burns.

Air to maintain combustion in the vessel is provided from the pressurized chamber surrounding the vessel through openings 48 in the sides of the vessel and the openings extending through grate plates 50. Such combustion air is provided from housing 14 through openings 60, 62, 64 which are controlled by dampers 190. As has been previously described, such combustion air enters through holes 48 in a whirling, or vortex, motion which aids in combustion, tending to swirl and dry fuel dropped into the top of the vessel from apron 154. Further, the fuel in pile 156 resting on apron 154 is predried to some extent by the heat within the furnace itself. As the combustion gases rise from vessel 46 they continue to burn and produce greater heat as they travel through the primary, secondary and tertiary combustion zones.

In each of these combustion zones, additional air, or return gases, are provided through openings 200, 202, 204, 206 208.

The heated gases then pass into plenum chamber 100 and are exhausted through nozzles 102 into the dryer for recirculation by fans 104 within the dryer.

Due to the moisture within the fuel used within the furnace the heated gases arriving at the dryer have a moisture content which produces faster heating of the veneer. Since the furnace and the dryer are both pressurized higher heat values may be maintained in the moist furnace gases also.

As the veneer is dried by the gases in the dryer, moisture and material carried in the moisture released from the veneer are exhausted from the dryer through ducts 116, 118 to fan 120 to be reinjected into housing 70, and from the cooler zone of the dryer duct 130 carries such gases to fan 132 for reinjection into housing 70 adjacent the infeed end of the furnace. These recirculated dryer gases including combustible pollutants and moisture released from the veneer are reinjected into the combustion chamber of the furnace either through openings 60, 62, 64, or through the various other damper controlled openings within the various combustion zones. In this way, the pollutant materials are substantially fully combusted on recirculated passes through the combustion chambers and the moisture from the veneer is added to the moisture of the fuel to maintain moist heat for more quickly drying the veneer.

Damper 126 in exhaust stack 124 controls the exhaust of the lighter exhaust gases from the dryer, whereby only a minor portion of the gases are released and these include only very minor and inconsequential quantities of pollutants.

Describing the operation of the control mechanism, should the dryer temperature drop below a preselected level this is sensed by thermocouple 174 which operates through control circuit 172 to open dampers 160 in exhaust nozzles 102 to admit more heated gases to the dryer to raise the temperature therein. Upon the opening of dampers 160 there is a corresponding drop in pressure throughout the combustion zones of the furnace. This drop in pressure is sensed by probe 180 and control circuit 182. Upon sensing of this drop in pressure, control circuit 182 operates to increase the fuel feed provided by screw conveyor 148 and open dampers 190 to provide greater burning of fuel within the combustion chamber to again raise the heat and pressure within the furnace and dryer to preselected levels. When the temperature in the dryer and the pressures within the combustion chamber reach preselected level, the control devices reverse the above-described operation to stabilize the system at a preselected temperature and pressure balance.

The following table illustrates an example of the temperatures and presssures which may be established in one desired operating condition for the combination, with the temperatures in °F. and the pressures in inches of water:

| Area or Zone | Temperature | Pressure |
|---|---|---|
| Housing | 185° F | 9" $H_2O$ |
| Primary Combustion Zone | 1650 | 8.5 |
| Secondary Combustion Zone | 1100 | 8 |
| Tertiary Combustion Zone | 800 | 7 |
| Dryer | 375–425 | 2 |

It should be realized that the above are examples of the conditions existing in only one operating mode, however, and these may be varied as needed.

From the above, it should be evident that dryer gases recirculated through the combustion chamber under totally pressurized conditions in both the combustion chamber and dryer result in significant decreases in the quantity of pollutant materials exhausted into the atmosphere, and increase the thermal efficiency of the overall combination resulting in a highly efficient combination which produces minimal, or inconsequential, quantities of pollutant material.

While a preferred embodiment of the invention is described herein, it should be apparent to those skilled in the art that variations and modifications are possible without departing from the spirit of the invention.

It is claimed and desired to secure by Letters Patent:

1. A recirculating furnace-dryer combination comprising a combustion chamber in which a greater than atmospheric pressure may be maintained, fuel feed means for feeding fuel to said combustion chamber, housing means surrounding said combustion chamber in which a greater than atmospheric pressure may be maintained, dryer means for receiving materials to be dried, said dryer constructed to maintain a greater than atmospheric pressure therein, feed conduit means through which combustion gases may flow from said combustion chamber to said dryer, return conduit means connecting said dryer to said housing for returning gases from said dryer to said housing, means for admitting controlled quantities of returning gases to said combustion chamber from said housing, and pressurizing means for producing a greater than atmospheric pressure throughout said combustion chamber, housing, dryer, and feed conduit means and in said return conduit means during operation.

2. The combination of claim 1, wherein said pressurizing means comprises a fan operatively connected in said return conduit means.

3. The combination of claim 1, wherein said means for admitting controlled quantities of return gases includes means defining an opening extending between said housing and combustion chamber, damper means in said opening intermediate said housing means and combustion chamber, and adjustment means for selectively varying the position of said damper means within said opening.

4. The combination of claim 1, which further comprises pressure sensing means operable to sense the pressure within said combustion chamber and operator means operatively interconnecting said fuel feed means and means for admitting return gases to said combustion chamber with said pressure sensing means and operator means being operable to control the rate of fuel feed and admission of return gases to said combustion chamber in relation to the pressure within the combustion chamber.

5. The combination of claim 4, which further comprises adjustable means for selectively controlling the flow of heated gases from said feed conduit to said dryer means, temperature sensing means for sensing the temperature in said dryer means, and control means interconnected to said adjustable means and temperature sensing means operable to control the operation of the former in relation to the temperature sensed by the latter for maintaining the temperature within said dryer means within a preselected range.

6. The combination of claim 5, which further comprises return control means operable to control the flow of gases from said dryer means to said return conduit means.

7. The combination of claim 1, wherein said fuel feed means comprises air lock means operable to inhibit release of pressure from the combustion chamber to which fuel is fed by said fuel feed means.

8. The combination of claim 1, wherein said dryer includes a plurality of zones through which materials are carried in a drying process, and each of said zones in connected to said return conduit means for recirculation of gases and particulate matter therefrom to said housing.

9. The combination of claim 1, wherein said combustion chamber includes an upright cylindrical vessel in which fuel is ignited, and the walls of said vessel have openings extending therethrough at an angle to a line extending radially from the center of the vessel, through which openings gases from said housing may flow to produce a vortex movement within the vessel.

10. The combination of claim 9, wherein said furnace comprises means defining an enclosure producing a chamber extending about said vessel, and said means for admitting quantities of return gases comprises means for producing a pressure about said vessel greater than the pressure within said vessel, whereby said gases enter said vessel through said openings to produce said vortex.

11. The combination of claim 1, which further comprises a fuel holding ledge adjacent the infeed side of said combustion chamber for holding a loose quantity of fuel for heating and drying prior to the same being injected fully into said combustion chamber for burning.

12. The combination of claim 1, wherein said combustion chamber includes a plurality of combustion zones and said means for admitting return gases comprises damper means for admitting selectively controlled quantities of return gases to each of said zones.

13. A recirculating furnace-dryer combination comprising a combustion chamber, fuel feed means for feeding fuel to said combustion chamber while maintaining a greater than atmospheric pressure within said chamber, housing means surrounding said combustion chamber for maintaining a greater than atmospheric pressure therein and in said combustion chamber, dryer means for receiving materials to be dried, said dryer means being constructed to maintain a greater than atmospheric pressure therein, feed conduit means through which combustion gases may flow from said combustion chamber to said dryer means, pressurizing means for producing a greater than atmospheric pressure throughout said combustion chambers, housing, dryer and feed conduit means during operation, return conduit means connecting said dryer means to said housing for returning dryer gases to said housing, admission means for admitting controlled quantities of return gases to said combustion chamber from said housing, means for sensing the temperature within said dryer means, means operatively connected to said temperature sensing means for controlling quantities of combustion gases released from said feed conduit means to said dryer means in relation to the temperature sensed in said dryer, means for sensing the pressure in said combustion chamber, and means operatively connected to said pressure sensing means for controlling the rate of fuel feed to said combustion chamber and a quantity of return gases admitted to said combustion chamber in relation to the pressure in said combustion chamber.

14. The combination of claim 13, wherein said means for admitting controlled quantities of return gases includes means defining an opening between said housing and combustion chamber, damper means in said opening intermediate said housing means and combustion chamber, and adjustment means for selectively varying the position of said damper means witin said opening.

15. The combination of claim 13, which further comprises return control means operable to control the flow of gases from said dryer into said return conduit.

16. The combination of claim 13, which further comprises pressurizing means for producing a greater than atmospheric pressure in said combustion chamber, housing, dryer and feed and return conduits.

* * * * *